US010808671B2

(12) United States Patent
Greene

(10) Patent No.: US 10,808,671 B2
(45) Date of Patent: Oct. 20, 2020

(54) IGNITION SAFETY CONTROL

(71) Applicant: Randy Greene, White Pine, TN (US)

(72) Inventor: Randy Greene, White Pine, TN (US)

(73) Assignee: Randy Greene, White Pine, TN (US)

( * ) Notice: Subject to any disclaimer, the term of this patent is extended or adjusted under 35 U.S.C. 154(b) by 67 days.

(21) Appl. No.: 15/474,783

(22) Filed: Mar. 30, 2017

(65) Prior Publication Data

US 2018/0283341 A1 Oct. 4, 2018

(51) Int. Cl.

| | |
|---|---|
| ***F02N 11/10*** | (2006.01) |
| ***F02N 11/08*** | (2006.01) |
| ***F02N 15/06*** | (2006.01) |
| ***F02N 11/00*** | (2006.01) |

(52) U.S. Cl.

CPC ..... *F02N 11/106* (2013.01); *F02N 11/087* (2013.01); *F02N 11/00* (2013.01); *F02N 11/10* (2013.01); *F02N 15/067* (2013.01)

(58) Field of Classification Search

CPC ... F02N 11/106; F02N 11/087; F02N 11/0862
USPC ..... 123/179.3
See application file for complete search history.

(56) References Cited

U.S. PATENT DOCUMENTS

| | | | | |
|---|---|---|---|---|
| 2,847,656 | A * | 8/1958 | Ricks | H01R 11/30 340/457 |
| 3,921,613 | A * | 11/1975 | Thirion | H01H 27/063 123/179.3 |
| 4,037,578 | A | 7/1977 | Dersch et al. | |
| 4,291,653 | A | 9/1981 | Tucker | |
| 4,490,620 | A | 12/1984 | Hansen | |
| 4,622,930 | A | 11/1986 | Hamano et al. | |
| 4,689,603 | A | 8/1987 | Conigliaro et al. | |
| 4,731,543 | A | 3/1988 | Buetemeister et al. | |
| 4,947,051 | A | 8/1990 | Yamamoto et al. | |
| 5,287,831 | A | 2/1994 | Anderson et al. | |
| 5,349,931 | A | 9/1994 | Gottlieb et al. | |
| 5,742,137 | A | 4/1998 | Bratton et al. | |
| 5,934,237 | A | 8/1999 | Vilou | |
| 5,983,850 | A | 11/1999 | Vilou | |
| 6,024,065 | A | 2/2000 | Hojna et al. | |
| 6,104,157 | A * | 8/2000 | Kramer | F02N 11/0851 318/430 |

(Continued)

FOREIGN PATENT DOCUMENTS

| | | | |
|---|---|---|---|
| CN | 201843718 U | * | 5/2011 |
| CN | 102562402 A | | 7/2012 |

(Continued)

OTHER PUBLICATIONS

CN-201843718-A—English Translation (Year: 2011).*
CN-201843718-U—English Translation (Year: 2011).*
CN-102852689-A—English Translation (Year: 2013).*

*Primary Examiner* — Joseph J Dallo
*Assistant Examiner* — Scott A Reinbold
(74) *Attorney, Agent, or Firm* — Pitts & Lake, P.C.

(57) ABSTRACT

A safety control system and method to be used with a starter system having a battery, ignition switch, starter, starter relay, and starter solenoid, the safety control system including an interrupt relay configured to be connected between a battery and the starter, and a controller configured to control the interrupt relay to selectively allow power from the battery to be supplied to the starter.

17 Claims, 4 Drawing Sheets

(56) References Cited

U.S. PATENT DOCUMENTS

| | | | | |
|---|---|---|---|---|
| 6,148,781 | A * | 11/2000 | Boegner | F02N 11/087 123/179.3 |
| 6,688,270 | B2 | 2/2004 | Hisamoto et al. | |
| 6,800,952 | B2 | 10/2004 | Blackburn et al. | |
| 7,145,259 | B2 | 12/2006 | Spellman et al. | |
| 7,150,253 | B2 | 12/2006 | Itou et al. | |
| 7,677,216 | B2 | 3/2010 | Sugano et al. | |
| 8,112,185 | B2 | 2/2012 | Wu | |
| 9,500,173 | B2 | 11/2016 | Casey et al. | |
| 2010/0134934 | A1* | 6/2010 | Matsubara | F02N 11/087 361/49 |
| 2017/0268474 | A1* | 9/2017 | Kirk | F02N 11/087 |
| 2018/0149104 | A1* | 5/2018 | Yamashita | F02N 11/106 |

FOREIGN PATENT DOCUMENTS

| | | | | |
|---|---|---|---|---|
| CN | 102852689 | A | * | 1/2013 |
| CN | 102852689 | A | | 1/2013 |
| CN | 101413452 | B | | 3/2013 |
| CN | WO 2016/090185 | | | 6/2016 |

* cited by examiner

IGNITION SAFETY CONTROL

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The present general inventive concept relates to an ignition safety control system to selectively control the power supplied from the battery of a motorized vehicle to the starter in a manner which assists in preventing both starter malfunction and safety problems.

BACKGROUND

Engine starters and starter relays can often malfunction and cause problems when power is continually supplied to the starter and/or starter solenoid at inappropriate times. Safety hazards, including fires and explosions, can be caused by continually supplying power to the starter or starter solenoid of a motorized vehicle at such inappropriate times, such as when the engine has already started. Inadvertently supplying the primary battery power directly to the starter, such as when the starter circuit is shorted to ground, has been a longstanding problem. Therefore, there exists a need to prevent the continuous supply of power to the starter and/or starter solenoid during these inappropriate times.

BRIEF SUMMARY

Various example embodiments of the present general inventive concept provide an ignition safety control to selectively control the power supplied from the battery of a motorized vehicle to the starter through a starter relay and starter solenoid. In various example embodiments of the present general inventive concept, the ignition safety control interrupts the primary power from the battery to the starter when the power is not needed during the starting cycle of the engine. In various example embodiments the ignition safety control also selectively breaks the circuit between both the ignition system and the starter relay and the battery. Thus, the operation of the ignition safety control isolates the starter from the battery when use of the starter is not desired.

Additional aspects and advantages of the present general inventive concept will be set forth in part in the description which follows, and, in part, will be obvious from the description, or may be learned by practice of the present general inventive concept.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
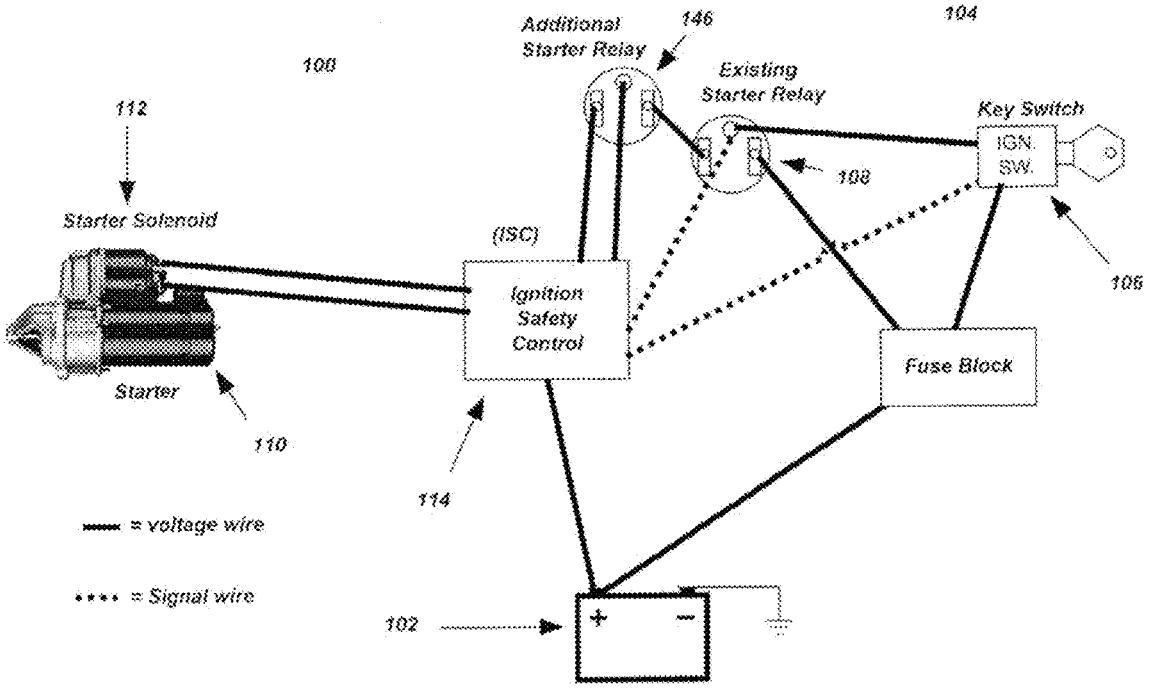
FIG. 1 is a schematic view of a safety control system incorporating an ignition safety control constructed in accordance with an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

The present general inventive concept provides an ignition safety control connected between a battery and a starter in a motorized vehicle, said safety control including circuitry for interrupting the connection of said battery with said starter if said starter is not in a routine starting cycle. Various example embodiments of the present general inventive concept are directed to the provision of a safety control system which selectively controls the power supplied directly from the battery of an automobile to the starter in a manner which is designed to enhance the safe operation of the starter, assist in preventing starter malfunction, and further assist in eliminating chattering of the starter as may be occasioned if the starter solenoid and starter are simultaneously powered by the battery at the initialization of the start engine cycle. The circuitry of various example embodiments of the present general inventive concept provides an ignition safety control to interrupt the primary power from the battery to the starter when the power is not needed during the starting of the engine. The ignition safety control may also selectively break the circuit between both the ignition system and the starter relay, and the battery. Thus the operation of the ignition safety control isolates the starter from the battery, when use of the starter is not desired. Various example embodiments of the present general inventive concept may be retro-actively fitted into pre-existing starter systems, which typically include a battery, ignition switch, starter relay, starter solenoid, and starter.

It is noted that in many of the various example embodiments described herein, at least portions of the logic circuitry is performed by programmable relays, and is described specifically as such. However, it is understood that these programmable relays are simply one possible implementation of the present general inventive concept, and various other example embodiments may be implemented with various other types of circuitry. For example, the two programmable relays described herein may be replaced by one or more dedicated chipsets such as Application Specific Integrated Circuits (ASICs). These chipsets may also include other components described herein, such as the redundancy relay which is introduced in FIG. 2. As such, the pins representing the various inputs and outputs in the relays described herein are simply for ease of understanding of the corresponding example embodiments described, wherein other chipsets may employ different configurations, orientations, and so on to sense various states of other components through input signals, and notify and/or control other components through output signals. Also, while the example embodiments described herein provide redundant circuitry safety control, various other example embodiments may provide ignition safety control with fewer or no such redundant features.

Referring to FIG. 1, an ignition safety system according to an example embodiment of the present general inventive concept is shown generally at 100. This ignition safety system 100 includes a battery 102 which supplies power for the various components and circuits of the ignition safety system 100. The battery is connected to a standard ignition system 104 that includes a key and an ignition switch 106 shown in FIG. 1. The ignition system 104 may be connected to the starter relay 108 in a conventional manner. The starter relay 108, which is the existing, original starter relay provided in the starter system, may be referred to herein as the original starter relay 108 to differentiate this element from an additional starter relay 146 that may be employed in various example embodiments along with the original starter relay 108. The starter 110 is energized by the starter solenoid 112 when battery power is applied to it. It will be noted that an ignition safety control 114 is included in the ignition safety system 100 of the present general inventive concept to provide redundant safety features that will be described in greater detail hereinafter. Moreover, this ignition safety control 114 is configured to interrupt the primary power supplied from the battery 102 to the starter 110. In this regard, it will be noted that the battery is connected to the starter only through the ignition safety control 114. It will further be noted that the ignition safety control 114 further provides a redundant interruption of the power supply to the starter solenoid 112 and the starter 110 by virtue of the fact that the ignition safety control 114 is connected between the battery 102 and both the starter solenoid 112 and the starter 110.

Figure 2:
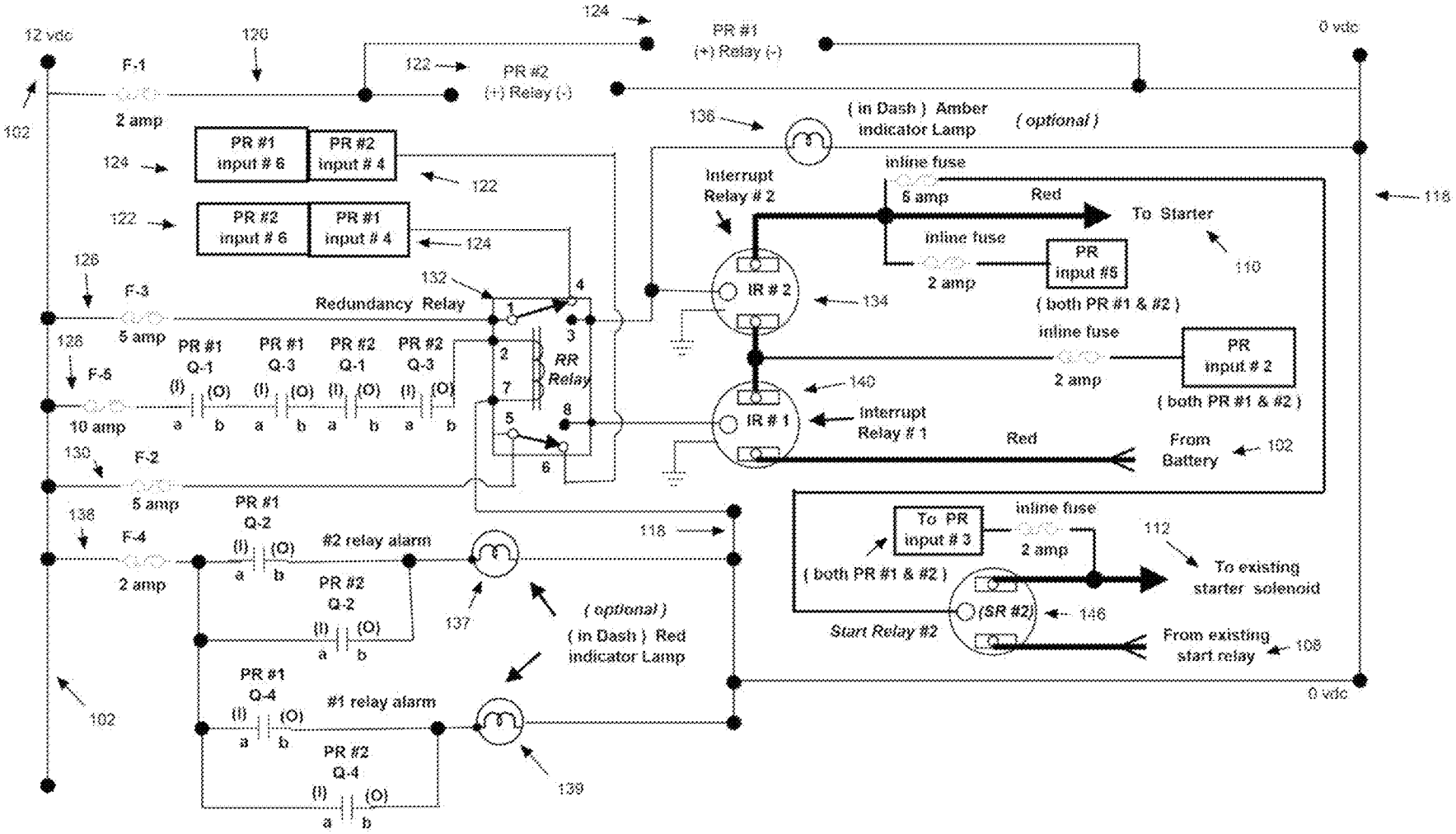
FIG. 2 is a ladder diagram of various components of the circuitry during different stages of operation according to an example embodiment of the present general inventive concept.

A ladder diagram of the ignition safety system 100 and the connections with the ignition safety control 114 is shown in FIG. 2. As will be described in greater detail, all circuits between the battery and the starter are directed through the ignition safety control 114 which readily enables disruption of the primary power flowing from the battery 102 to the starter 110 when prompted to do so by the reception of certain state signals. Thus, a valuable feature of the current present general inventive concept is the disruption of the flow of current directly from the battery 102 to the starter 110. It is the direct circuit that provides the most amperage and power to the starter 110 that is a common cause of safety problems such as fires if the battery power is inappropriately applied to the starter 110, which may be caused by, for example, a short circuit, a defective component, etc.

In this regard, it will be noted that the battery 102 is connected to the starter 110 only through the ignition safety control 114 in various example embodiments of the present general inventive concept. Referring now to the Figures, it will be noted that the ignition safety control 114 is interposed between the battery 102 and the starter 110, and between the original starter relay 108 and the starter solenoid 112. The interposition of the ignition safety control 114 as described provides the two redundant circuits that are valuable features regarding the safety aspects of the operation of the ignition safety control 114 according to the present general inventive concept.

Referring more specifically to the ladder diagram of FIG. 2, which is also a wiring schematic, it will be noted that the battery is shown at 102 and the ground at 118. It will be noted on the first rung 120 of the ladder diagram a first programmable relay (PR #1) is indicated at 124, and a second programmable relay (PR #2) is indicated as 122, at the upper part of FIG. 2. In various example embodiments of the present general inventive concept, the first and second programmable relays 124 and 122 are identical and suitable relays are manufactured by a variety of manufacturers. It is again noted that while some of the figures and corresponding descriptions herein are representative of an example embodiment of the present general inventive concept that employs programmable relays, various other example embodiments may be implemented as one or more dedicated chipsets such as, for example, an ASIC. In such embodiments, the chosen chipset would employ internal logic to perform the same or similar sensing and control operations that are dependent upon signals sent to and/or received from other components of the ignition system, such as the starter, ignition, starter relay, starter solenoid, interrupt relays, etc. In various example embodiments of the present general inventive concept, the component logic may conduct redundant testing through the use of two identical chipsets, such as, for example, dedicated chipsets or programmable relays.

Figure 3:
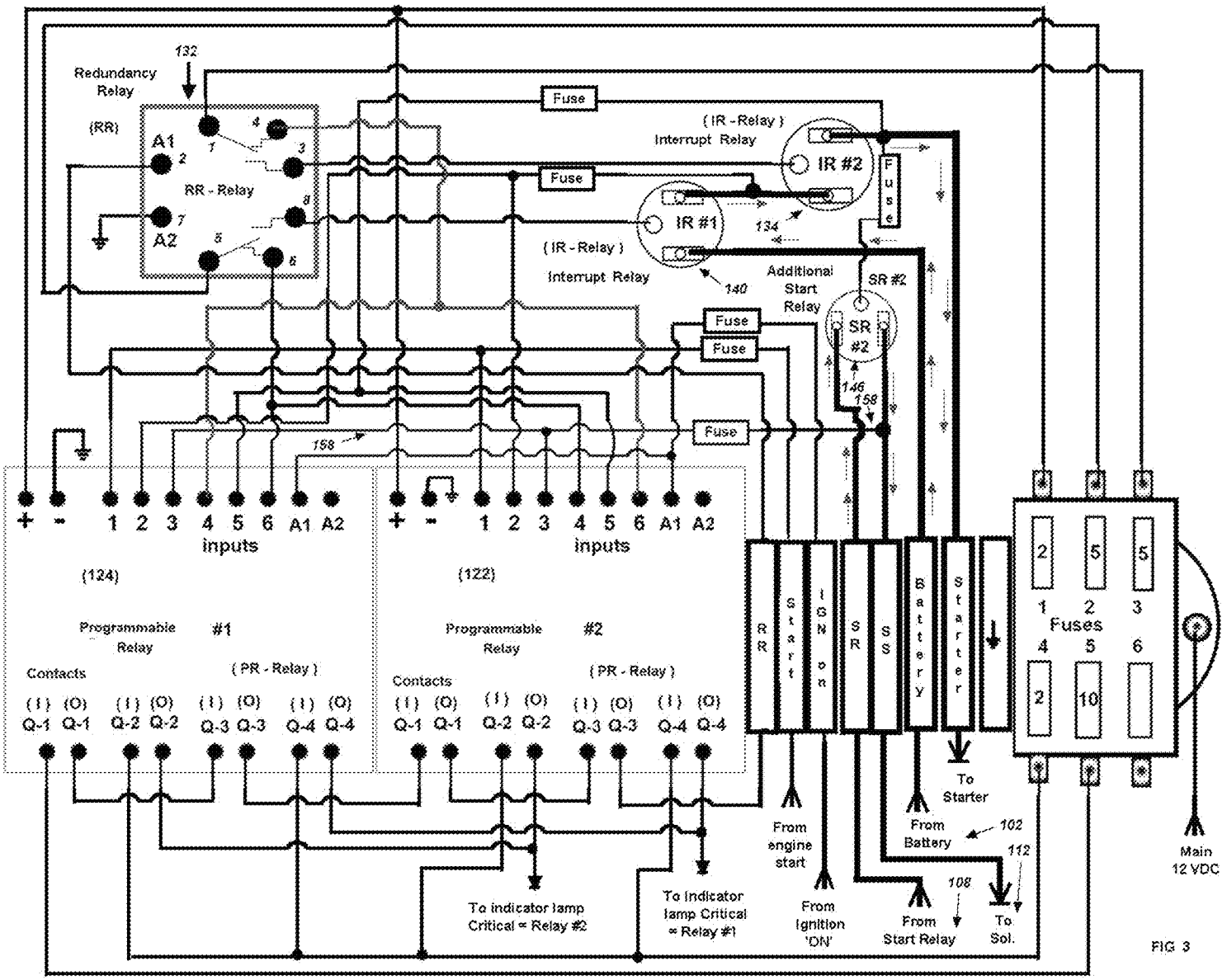
FIG. 3 is a circuit diagram of the safety control system shown in FIG. 1 and incorporating the ignition safety control which selectively energizes and/or de-energizes various components of the circuitry according to an example embodiment of the present general inventive concept.

In the example embodiment illustrated in FIGS. 2-3, the program logic consists of multiple testing sources and sequences which together monitor the starting process and create the ability to allow the starter application to energize or disengage the voltage to the starter process. These programmable relays 124 and 122 are connected in parallel as shown in the upper portion of FIG. 2. As illustrated in FIG. 3, along with the power and ground pins, each of the programmable relays 124 and 122 have a plurality of input pins 1-6 and A1-A2 (in different example embodiments, the pins may be numbered 1-8), as well as four relays each having an input and an output pin. These paired relay pins are indicated in FIG. 3 as Q-1-I, Q-1-O, Q-2-I, Q-2-O, and so on for each of the programmable relays. However, referring back to the ladder diagram representation in FIG. 2, it will be noted that one side of each programmable relay 124 and 122 is connected to the 12-volt battery 102 through the illustrated two amp fuse F-1. The other respective poles of the programmable relays 122 and 124 are connected to the ground 118. The second rung of the ladder is shown at 126 in FIG. 2. The third rung 128 of the ladder and the fourth rung 130 of the ladder are fed through fuses F-5 and F-2, respectively, to a redundancy relay 132. It is understood that while the example embodiments described herein include programmable relays, various other example embodiments may employ one or more ASIC's or other types of chipsets, in fewer or greater numbers than those shown in FIGS. 2-4, to perform the sensing/monitoring, controls, switching, processing, etc., to perform the ignition safety control discussed herein.

The battery 102 is connected through fuse F-3, which in the depicted example embodiment is a 5-amp fuse, to pin 1 on the redundancy relay 132. The battery 102 is also connected through fuse F-2, which is depicted as a 5-amp fuse, to pin 5 on the redundancy relay 132. Thus, current from the battery 102 is supplied through fuse F-3 in rung 126 to pin 1 on the redundancy relay 132, and current from the battery 102 is supplied through fuse F-2 to pin 5 of the redundancy relay 132. In the normally closed position illustrated in FIG. 2, the redundancy relay 132 connects pins 1 and 4 and pins 5 and 6 as shown. In this normally closed position, a switchable connection between pins 1 and 4 is closed, or connected, and a switchable connection between pins 1 and 3 is open, or unconnected. Similarly, in this normally closed position, a switchable connection between pins 5 and 6 is closed, or connected, and a switchable connection between pins 5 and 8 is open, or unconnected. Thus, in the normally closed circuit, pin 4 of the redundancy relay 132 connects to the input 4 of the first programmable relay 124 and input 6 of the second programmable relay 122, and pin 6 of the redundancy relay 132 connects to the input 4 of the second programmable relay 122 and input 6 of the first programmable relay 124.

It will be noted in FIG. 2 that pins 3 and 8 of the redundancy relay 132 are respectively connected to a pair of power interrupt relays, hereinafter referred to as the first interrupt relay 140 and second interrupt relay 134. Pin 3 of redundancy relay 132 is connected to the second interrupt relay 134, and pin 8 of the redundancy relay 132 is connected to the first interrupt relay 140. As illustrated in FIG. 2, in this example embodiment of the present general inventive concept, pin 3 of the redundancy relay 132 is also connected to an in-dash amber indicator lamp 136. The in-dash lamp 136 may be optional in various example embodiments of the present general inventive concept. The color of the lamp 136, shown in FIG. 2 to be amber, may also vary according to different embodiments of the present general inventive concept. Also, various example embodiments may employ an audio alarm along with, or instead of, such an in-dash lamp or other type of screen display. According to various example embodiments of the present general inventive concept, one or more optional additional in-dash indicator lamps 137 and 139 may be provided to indicate relay alarms. In the example embodiment of FIG. 2, the indicator lamps 137 and 139 are red lamps indicating a relay alarm. It is noted that various example embodiments may provide differently colored lamps or other visual displays, as well as independent or combined audio alerts. As shown in FIG. 2, current from the battery 102 flows through fuse F-4 into the Q-2-I and Q-4-I pins of both programmable relays 124 and 122.

Although the purpose and function of the various inputs of the programmable relays 124 and 122 will be come more clear with the detailed description of this example embodiment of the present general inventive concept, a brief introduction of the input pins may aid in ease of understanding some of the functions of the ignition safety control. The programmable logic is reading inputs from various locations in the ignition safety control and existing ignition system, searching and recognizing available voltage from different areas of the starting circuits. The programmable logic of these programmable relays 124 and 122 searches for the following inputs: Input A1 (otherwise known as input 7), which detects voltage applied from the battery 102; Input 1, which detects the voltage applied to the starter circuit, the ignition voltage applied; Input 2, which detects the applied voltage from the first interrupt relay 140 going to the second interrupt relay 134; Input 3, which detects the applied voltage from the second interrupt relay 134 going to the starter solenoid 112; Inputs 4 and 6, which receive the de-activation voltage corresponding to the first and second interrupt relays 140 and 134, which in other words detect the voltage to the opposing circuits of the activating voltage applied to the first and second interrupt relays 140 and 134; and Input 5, which detects the applied voltage from the second interrupt relay 134 to the starter 110. In addition to the recognition of voltage, the program logic monitors the activation of each circuit to ensure the sequence of activation is not interrupted and/or does not occur out of sequence. Any interruption of the above applications will cause an interruption of the relay contacts shown as Q1 or Q3 in FIG. 3, which will cause the redundancy relay 132 to de-activate the interrupt relays 140 and 134.

When either of the Q-2 relays is activated, signals from the Q-2-O pins of either of the programmable relays 124 and 122 are sent to the indicator lamp 137 to indicate a critical condition, or alarm state, of either programmable relay. When either of the Q-4 relays is activated, signals from the Q-4-O pins of either of the programmable relays 124 and 122 are sent to the indicator lamp 139 to indicate a critical condition, or alarm state, of either programmable relay. Critical alarms may include improper or unscheduled activation of either of the interrupt relays and/or the starter relays. A critical alarm may also indicate failure of the redundancy relay and/or the programmable relays.

As previously described, pin 4 of the redundancy relay 132 connects to the input 4 of the first programmable relay 124 and input 6 of the second programmable relay 122, and pin 6 of the redundancy relay 132 connects to the input 4 of the second programmable relay 122 and input 6 of the first programmable relay 124. Thus, pins 4 and 6 of the redundancy relay 132 are connected to the same programmable relays, but in a reverse fashion. In this manner, the circuits are testing each other at the same time to assure that neither is failing. As both programmable relays hold identical program logic, by using two different inputs on the two separate programmable relays, a test is performed on the programmable logic as well as on the relays. Various other example embodiments of the present general inventive concept may provide ignition safety control circuitry without the redundant circuitry described herein and illustrated in FIGS. 2-3.

As illustrated in FIG. 2, pin 5 of the redundancy relay 132 is internally switchable between pins 6 and 8. Normally, pin 5 will be connected to pin 6, as previously described. Pin 8 of the redundancy relay 132 is connected to the first interrupt relay 140, and is configured to activate the first interrupt relay 140 that interrupts the power supply from the battery 102 to the starter 110 when de-activated. Similarly, pin 1 is internally switchable between pins 4 and 3 in the redundancy relay 132, and pin 3 is connected to the second interrupt relay 134. In various example embodiments of the present general inventive concept, both power interrupt relays 134 and 140 are activated at the same time to complete the circuit from the battery 102 to the starter 110.

Thus, the main amperage supply from the battery 102 to the starter 110 can be interrupted in the event of failure.

Figure 4:
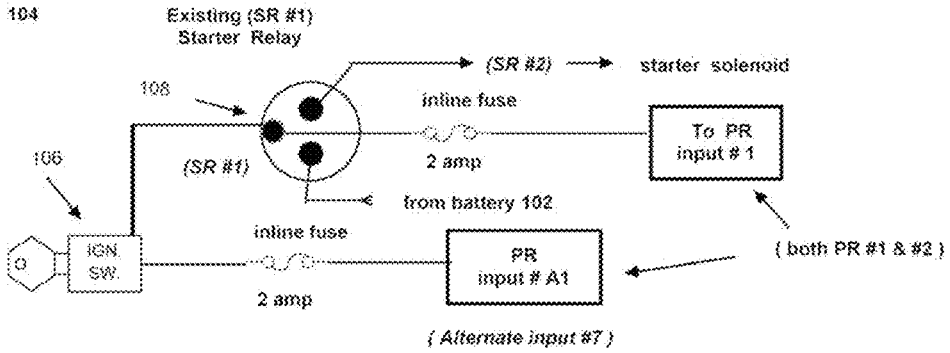
FIG. 4 illustrates an ignition system in electrical communication with components a safety control system according to an example embodiment of the present general inventive concept.

As previously described, and as illustrated in FIG. 2, pin 5 of the redundancy relay 132 is normally connected to pin 6, and pin 1 is normally connected to pin 4. When the switchable connection is switched so that pin 5 is connected to pin 8, a connection is made between pin 8 and the first interrupt relay 140. Similarly, when the switchable connection is switched so that pin 1 is connected to pin 3, a connection is made between pin 3 and the second interrupt relay 134. Using both of these first and second interrupt relays 140 and 134, the circuit from the battery 102 to the starter 110 is completed. Thus, the main amperage from the battery 102 is applied to the starter 110. At the same time that power is fed through the first and second interrupt relays 140 and 134 to the starter 110, it is noted that the output current of both starter relays and both interrupt relays are being monitored for activation through the connected inputs. Pin 4 of the redundancy relay 132 is connected to input 6 of the second programmable relay 122, and also to input 4 of the first programmable relay 124, which allows the programmable relays 124 and 122 to simultaneously monitor the voltage through the redundancy relay 132 for accuracy upon de-activation of pin 3 of the redundancy relay 132 to the second interrupt relay 134. Pin 6 of the redundancy relay 132 is connected to input 4 of the second programmable relay 122 and also to input 6 of the first programmable relay 124, which allows the programmable relays 124 and 122 to simultaneously monitor the voltage through the redundancy relay 132 for accuracy upon de-activation of pin 8 of the redundancy relay 132, which activates the gate of the first interrupt relay 140. Input 2 of both programmable relays 124 and 122 simultaneously monitor the voltage supplied from the output side of the first interrupt relay 140 to the input side of the second interrupt relay 134 to ensure proper activation and proper de-activation of supplied voltage from the battery 102 through the first interrupt relay 140. Input 5 of both programmable relays 124 and 122 simultaneously monitor the voltage supplied from the output side of the second interrupt relay 134 to the starter 110 to ensure proper activation and proper de-activation of supplied voltage from the first interrupt relay 140 through the second interrupt relay 134. Input 3 of both programmable relays 124 and 122 simultaneously monitor the voltage supplied from the output side of an additional, or auxiliary, starter relay 146, which will be described in more detail later, to the starter solenoid 112 to ensure proper activation and proper de-activation of supplied voltage from the original starter relay 108 through the additional starter relay 146. Input 1 of both programmable relays 124 and 122 simultaneously monitor the voltage applied to the activation of the original starter relay 108 which results in current being applied through the original starter relay 108 to the input side of the additional starter relay 146 to ensure proper activation and proper de-activation of supplied voltage from the ignition switch 106 through the original starter relay 108. Input A1 (otherwise known as input 7) of both programmable relays 124 and 122 simultaneously monitor the voltage supplied from the ignition switch 106 to ensure a proper voltage of 10 volts DC or higher exists from the battery 102 to both programmable relays 124 and 122 for proper activation. This arrangement of inputs 1 and A1 in regard to the ignition switch 106 is illustrated in FIG. 4.

It will be noted that at the time power is supplied to the starter 110 from the battery 102, both the first and second interrupt relays 140 and 134 are activated, or connected, between the battery 102 and the starter 110. It will also be noted that the connections RR (from the second programmable relay 122 to the redundancy relay 132), Start (from engine starter 110 to the programmable relays 124,122), IGN on (from the ignition 106 to the programmable relays 124,122), SR (from the original starter relay 108 to the auxiliary starter relay 146), SS (from the auxiliary starter relay 146 to the starter solenoid 112), Battery (from the battery 102 to the first interrupt relay 140), Starter (from the second interrupt relay 134 to the starter 110), and ground are simply connections to aid in the understanding of the schematic.

The first and second programmable relays 124 and 122 are activated into a ready to operate status by receiving an input signal at input A1 (otherwise known as input 7) on each of the programmable relays 124 and 122 when the ignition switch 106 is turned to the on position. The original starter relay 108 in the vehicle and input 1 of both programmable relays 124 and 122 are activated when the ignition switch 106 is turned to the start position. When activated, input 1 of both programmable relays 124 and 122 initiate the activation sequence of the redundancy relay 132. The redundancy relay 132, when initiated, activates both of the first and second interrupt relays 140 and 134. The additional starter relay 146 of the Ignition Safety Control is activated when the second interrupt relay 134 activates. The second interrupt relay 134 also supplies voltage to the starter 110 when activated. This completes the circuit between the battery 102 and the starter 110, and also completes the circuit between the battery 102 and the starter solenoid 112. In order for the redundancy relay 132 to pull in and activate both of these circuits, i.e., to switch connections such that pin 1 is connected to pin 3 and pin 5 is connected to pin 8, power is supplied through fuse F-5 in rung 128 to a series of relays in the first and second programmable relays 124 and 122. In more detail, in this example embodiment, current moves through fuse F-5 through Q-1-I, Q-1-O, Q-3-I, and Q-3-O of the first programmable relay 124, and then through Q-1-I, Q-1-O, Q-3-I, and Q-3-O of the second programmable relay 122. Q-3-O of the second programmable relay 122 is connected to pin 2 of the redundancy relay 132, as shown in FIGS. 2 and 3. Thus, when the Q-1 and Q-3 relays of both programmable relays 124 and 122 are activated, power is transmitted through fuse F-5 to pin 2 of the redundancy relay 132, which activates the redundancy relay 132 and provides voltage through both pins 1 and 5 respectively to pins 3 and 8 of the redundancy relay 132 to ensure redundancy on both the application of voltage to the first and second interrupt relays 140 and 134, and also redundancy of interruption of the voltage to the first and second interrupt relays 140 and 134. This example embodiment employs four separate output tests in order to allow the circuit to be completed.

Before the starter can be activated, the outputs are controlled by the logic in the programmable relays which gather information from the battery voltage, the starter switch (whether the "on" is received), and the starter activation switch (whether the "start" signal is received). Information from the existing starter solenoid 112 is also gathered in this collaborated information, enabling the programmable relays 124 and 122 to complete the power from the battery 102 to the starter 110, or to disable the application of power. In this example embodiment of the present general inventive concept, the activation and de-activation is monitored by the two separate programmable relays 124 and 122 containing identical logic which allows a starting time duration of a designated, or predetermined, time, upon expiration of which the programmable relays 124 and 122 disengage the starter voltage from the battery 102 until the key switch 106 has been switched to the "off" position and then turned back to the "on" and then the "start" positions, which results in the timing sequence restarting. In various example embodiments of the present general inventive concept, the predetermined time for which power from the battery 102 is allowed to be supplied to the starter 110 is calculated by circuitry inside the programmable relays 124 and 122. The programmable relays 124 and 122, which detect input signals from, and/or output signals to, various other components of the starter system and ignition safety control, may be referred to as control circuits, or controllers.

When the key of the ignition system is switched on a voltage of 10-volts or more is detected by the first and second programmable relays 124 and 122. This will not enable energizing the starter 110. Once the system goes into the start mode the voltage applied to the starter solenoid 112 is detected together with the voltage from the redundancy relay 132. Voltage from each of the interrupt relays 140 and 134 is also detected, in addition to the voltage from the original starter relay 108. All this information is used to perform a quick test to either release or lock out the application of power to the starter 110.

As previously described, current on rung 138 of the ladder diagram of FIG. 2 moves through fuse F-4 to the Q-2 and Q-4 relays of the first and second programmable relays 124 and 122 to control the activation of optional audible alarms and/or red indicator lamp alarms 137 and 139. These alarms represent acknowledgement of failure from the first and second interrupt relays 140 and 134. If any of these relays show failure, it results in interrupting the voltage which energizes the redundancy relay 132, which in turn, interrupts the voltage between the battery 102 and the starter 112.

Figure 5:
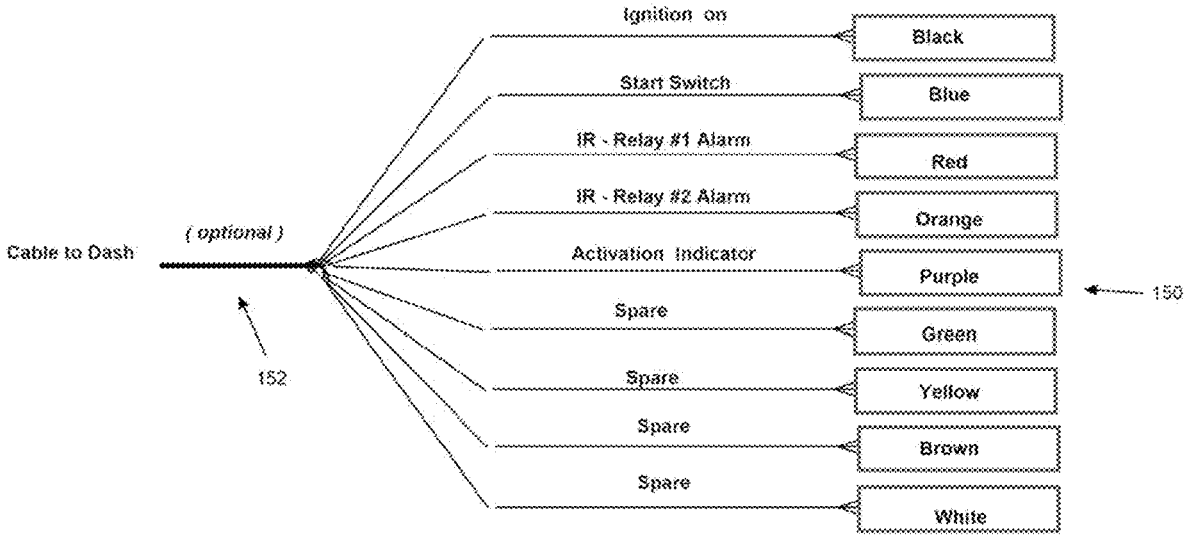
FIG. 5 illustrates various display readouts that may be depicted on the screen for troubleshooting purposes according to an example embodiment of the present general inventive concept.

If there is a system test that fails, for example, if there is an application of a voltage at an undesired location, one of the first or second programmable relays 124 or 122 will give a critical alarm. In various example embodiments, the alarm may include an optional dashboard indicator showing the alarm, together with optional flashing lights as shown in FIG. 2. The ignition system 104 is also shown in FIG. 2, which includes the ignition switch 106 and the key as indicated. It will be noted that the ignition switch 106 is connected through an in line fuse to input A1 (otherwise known as input #7) of both programmable relays 124 and 122, and when the key is turned to its "on" position, the voltage of 10-volts or more is typically supplied. If the key is turned to the start mode then power is supplied from the ignition switch 106 to the existing starter relay 108, and from the existing starter relay 108 a signal is supplied to input 1 of each of the programmable relays 124 and 122. According to various example embodiments, the optional dash display 150 shown in FIG. 5 may be supplied through an optional cable 152. This display may show a variety of conditions such as those outlined in FIG. 5, which include the ignition being in the on position, the start switch initiated, programmable relay alarm 139, programmable relay alarm 137, activation indicator, spare, etc. This application of alarm indicator lamps, alarm readout, alarm display, and alarm cable are optional components and are not needed for the safe functionality of the ignition safety control according to the present general inventive concept. These optional components are only for operator awareness of problems.

Referring to FIG. 3, in order to enhance the redundancy of the circuit, the additional starter relay 146 has been added between the existing starter relay 108 and the ignition safety control 114. More specifically, one pole of the additional starter relay 146 is connected to the starter relay 108, and through the opposite pole of the additional starter relay 146 to the starter solenoid 112. The additional starter relay 146 may be referred to as the auxiliary starter relay, or second starter relay SR #2, 146, and is activated by voltage applied to the starter 110 from the second interrupt relay 134. When the additional starter relay 146 is activated, a signal is also sent to pin 3 on each of the programmable relays 124 and 122 for indication of activation of the additional starter relay 146.

When the first interrupt relay 140 is activated so that current flows from the battery 102 to the second interrupt relay 134, current also flows from a point between the interrupt relays 140 and 134 to pin 2 on each of the programmable relays 124 and 122 for indication of activation of the first interrupt relay 140. When both interrupt relays 140 and 134 are activated such that current flows from the battery 102 to the starter 110, current also flows from a point between the second interrupt relay 134 and the starter 110 to pin 5 on each of the programmable relays 124 and 122 for indication of activation of the second interrupt relay 134, as well as to the additional starter relay 146 to activate the additional starter relay 146. When the additional starter relay 146 is activated, a signal is sent to pin 3 on each of the programmable relays 124 and 122. Also, when both interrupt relays 134 and 140 are activated, current flows from a point between the first and second interrupt relay 140 and 134 to pin 2 on each of the programmable relays 124 and 122.

FIG. 3 illustrates the connections illustrated FIG. 2, such as the connection from the battery 102 to the first and second interrupt relays 140 and 134 to the starter 110 in a wiring diagram. Thus, voltage going to the starter 110 is only active when the two interrupt relays 140 and 134 allow it to energize. This redundancy provides a valuable safety feature. When using two separate interrupt relays, an activation of the starter circuit is employed which is controlled and tested by two separate sources and two separate inputs simultaneously.

As illustrated in FIG. 3, a further testing circuit includes the output of the additional starter relay 146 being connected at a connection 158 to input 3 on both of the programmable relays. This testing circuit is configured to monitor and evaluate the activation sequence and duration of the additional starter relay 146, and to ensure proper activation and proper de-activation of the additional starter relay 146.

Figure 6:
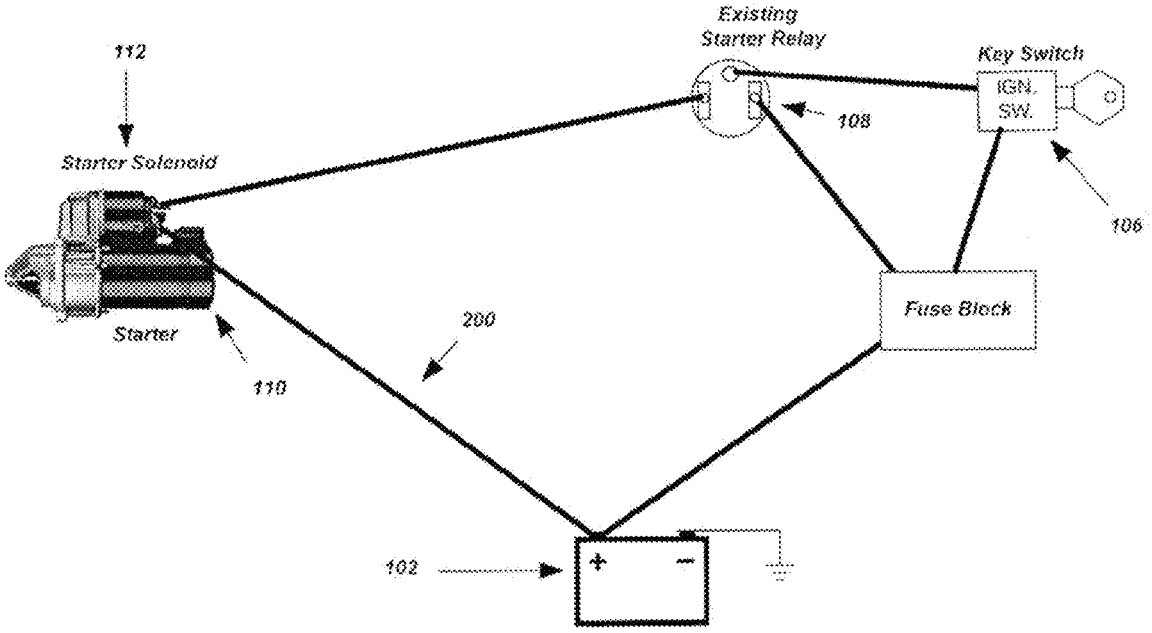
FIG. 6 illustrates a conventional wiring diagram of a starter on a typical combustible engine.

FIG. 6 illustrates a conventional wiring diagram of a starter on a typical combustible engine. This diagram illustrates the conventional arrangement in which the battery is connected directly to the starter as well as the ignition system, which is the method used to date. By adding an ignition safety control 114, such as the example embodiment of the present general inventive concept illustrated in FIG. 1, a safe connection is provided between the battery and starter.

According to various example embodiments of the present general inventive concept, provided is a safety control system to be used with a starter system having a battery, ignition switch, starter, starter relay, and starter solenoid, the safety control system including an interrupt relay configured to be connected between a battery and the starter, and a controller configured to control the interrupt relay to selectively allow power from the battery to be supplied to the starter. The controller may control the interrupt relay to allow power from the battery to be applied to the starter for a predetermined time before controlling the interrupt relay to stop allowing the power from the battery to be supplied to the starter. Upon controlling the interrupt relay to stop allowing the power from the battery to be supplied to the starter, the controller may be configured to not allow further power to be supplied to the starter until the ignition switch is turned to "off," then to "on," and then to "start." The safety control system may further include an auxiliary starter relay configured to be connected between the starter relay and the starter solenoid, and to allow current from the starter relay to the starter solenoid when in receipt of a signal indicating that power from the battery is being supplied to the starter. The controller may be configured to control the interrupt relay to allow the power from the battery to be supplied to the starter in response to the ignition switch being turned to "start." The safety control system may further include one or more alarm indicators that are controlled by the controller to indicate problems with one or more components of the safety control system. The one or more alarm indicators may be configured to be visual, audible, or a combination thereof. The safety control system may include first and second interrupt relays provided in series between the battery and the starter to provide redundancy in the safety control system. The safety control system may further include a redundancy relay circuit having first and second switches to selectively activate and de-activate the respective first and second interrupt relays to allow current to flow therethrough. The controller circuit may include first and second control circuitry configured to be identical in function to provide redundancy to the safety control system, and to control the interrupt relays through the first and second switches of the redundancy relay circuit. The controller may be configured to perform a plurality of safety tests before allowing the power from the battery to be supplied to the starter, the plurality of safety tests including detecting applied voltage to the controller, detecting applied voltage to the starter solenoid, detecting applied voltage to the redundancy relay, detecting applied voltage to the first and second interrupt relays, or any combination thereof. The controller may be configured to stop the power from the battery from being supplied to the starter in response to failure of any of the plurality of safety tests. The first and second control circuitry may be provided on a single chipset. The single chipset may also include the redundancy relay.

According to various example embodiments of the present general inventive concept, provided is a safety control system to selectively control the power supplied from the battery of a motorized vehicle started by an ignition system connected to the starter through a starter relay and starter solenoid, the safety control system including an ignition safety control configured to selectively control the starter relay and the starter solenoid to supply battery power to the starter in response to the ignition system being turned on, the ignition safety control including a redundant circuit configured to energize the starter relay to start the engine when the ignition system is turned on provided the ignition safety control detects an ignition signal and a starter signal simultaneously and related components are in their correct position or status, and the ignition safety control being configured to selectively apply power to the starter first, and then re-apply delayed power to the starter solenoid to avoid chattering of the starter. The safety control system may include an auxiliary starter relay connected between the existing starter relay and the starter solenoid to provide a redundant safety feature to the system. The safety control system may include first and second interrupt relays configured such that power is supplied to the starter only upon simultaneous closure of each of the first and second interrupt relays.

According to various example embodiments of the present general inventive concept, provided is a method of controlling a starter system having a battery, ignition switch, starter, starter relay, and starter solenoid, the method including controlling an interrupt relay connected between a battery and the starter so as to selectively allow power from the battery to be supplied to the starter for only a predetermined amount of time, and controlling the interrupt relay, after the power from the battery is supplied to the starter for the predetermined amount of time, to not allow the power from the battery to be supplied to the starter again before the starter system has been switched to an "off" position. Upon controlling the interrupt relay to stop allowing the power from the battery to be supplied to the starter, in some example embodiments further power may not be supplied to the starter until the ignition switch is turned to "off," then to "on," and then to "start." The method may further include controlling the interrupt relay to allow the power from the battery to be supplied to the starter in response to the ignition switch being turned to "start."

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A safety control system to be used with a starter system having a battery, ignition switch, starter, starter relay, and starter solenoid, the safety control system comprising:

first and second interrupt relays configured in series between the battery and the starter to provide redundancy in the safety control system;

a redundancy relay circuit having first and second switches to selectively activate and de-activate the respective first and second interrupt relays to allow current to flow therethrough; and two separate controllers each configured to control the first and second interrupt relays to selectively allow power from the battery to be supplied to the starter, and to selectively isolate the starter from the battery;

wherein the safety control system is configured such that the battery is connected to the starter only through the safety control system, wherein the first and second interrupt relays selectively interrupt a primary power supplied from the battery to the starter when controlled by the two separate controllers to isolate the starter, and wherein the two separate controllers are configured as a first control circuitry and a second control circuitry configured to test one another and test the first and second interrupt relays to provide the redundancy in the safety control system, and to control the first and second interrupt relays through the first and second switches of the redundancy relay circuit, each of the first and second switches being connected to both the first control circuitry and second control circuitry by connections reverse to one another such that connections between the first switch and the first control circuitry and second control circuitry are mirrored by connections between the second switch and the first control circuitry and second control circuitry.

2. The safety control system of claim 1, wherein the two separate controllers control the first and second interrupt relays to allow power from the battery to be applied to the starter for a predetermined time before controlling the first and second interrupts relay to stop allowing the power from the battery to be supplied to the starter.

3. The safety control system of claim 2, wherein upon controlling the first and second interrupt relays to stop allowing the power from the battery to be supplied to the starter, the two separate controllers will not allow further power to be supplied to the starter until the ignition switch is turned to "off," then to "on," and then to "start."

4. The safety control system of claim 1, further comprising an auxiliary starter relay configured to be connected between the starter relay and the starter solenoid, and to allow current from the starter relay to the starter solenoid when in receipt of a signal indicating that power from the battery is being supplied to the starter.

5. The safety control system of claim 1, wherein the two separate controllers are configured to control the first and second interrupt relays to allow the power from the battery to be supplied to the starter in response to the ignition switch being turned to "start."

6. The safety control system of claim 1, further comprising one or more alarm indicators that are controlled by the two separate controllers to indicate problems with one or more components of the safety control system.

7. The safety control system of claim 6, wherein the one or more alarm indicators are configured to be visual or audible.

8. The safety control system of claim 1, wherein the two separate controllers are configured to perform a plurality of safety tests before allowing the power from the battery to be supplied to the starter, the plurality of safety tests including detecting applied voltage to the two separate controllers, detecting applied voltage to the starter solenoid, detecting applied voltage to the redundancy relay, or detecting applied voltage to the first and second interrupt relays.

9. The safety control system of claim 8, wherein the two separate controllers are configured to stop the power from the battery from being supplied to the starter in response to failure of any of the plurality of safety tests.

10. The safety control system of claim 1, wherein the first and second control circuitry are provided on a single chipset.

11. The safety control system of claim 10, wherein the single chipset also includes the redundancy relay.

12. A safety control system to selectively control the power supplied from the battery of a motorized vehicle started by an ignition system connected to the starter through a starter relay and starter solenoid, the safety control system comprising:

an ignition safety control configured to selectively control the starter relay and the starter solenoid to supply battery power to the starter in response to the ignition system being turned on, the ignition safety control system being electrically connected between the battery and the starter, and between the starter solenoid and the starter relay, such that all circuits between the battery and the starter are directed through the ignition safety control system;

said ignition safety control including a redundant circuit configured to energize the starter relay to start the engine when the ignition system is turned on provided the ignition safety control detects an ignition signal and a starter signal simultaneously and related components are in their correct position or status; and said ignition safety control being configured to selectively apply primary power to the starter first, and then re-apply delayed power to the starter solenoid to avoid chattering of the starter;

said ignition starter relay including first and second interrupt relays configured in series between the battery and the starter to provide redundancy, and two separate controllers configured as a first control circuitry and a second control circuitry configured to test one another and test the first and second interrupt relays to provide redundancy, the first and second interrupt relays being independently and selectively activated by first and second switches that both receive control signals from the redundant first control circuitry and second control circuitry in the redundant circuit, each of the first and second switches being connected to both the first control circuitry and second control circuitry by connections reverse to one another such that connections between the first switch and the first control circuitry and second control circuitry are mirrored by connections between the second switch and the first control circuitry and second control circuitry.

13. The safety control system of claim 12, including an auxiliary starter relay connected between the existing starter relay and the starter solenoid to provide a redundant safety feature to the system.

14. The safety control system of claim 12, wherein the first and second interrupt relays are configured such that power is supplied to the starter only upon simultaneous closure of each of the first and second interrupt relays.

15. A method of controlling a starter system having a battery, ignition switch, starter, starter relay, and starter solenoid, the method comprising:

controlling, by two separate controllers, first and second interrupt relays connected in series between the battery and the starter so as to selectively allow a primary power supplied from the battery to be supplied to the starter for only a predetermined amount of time; and controlling, by the two separate controllers, the first and second interrupt relays, after the power from the battery is supplied to the starter for the predetermined amount of time, to not allow the power from the battery to be supplied to the starter again before the starter system has been switched to an "off" position;

wherein the battery is electrically connected to the starter only through the first and second interrupt relays, and wherein the two separate controllers are configured to provide redundancy as a first control circuitry and a second control circuitry configured to test one another and test the first and second interrupt relays, the first and second interrupt relays being independently and selectively activated by first and second switches that both receive control signals from the redundant first control circuitry and second control circuitry, each of the first and second switches being connected to both the first and second control circuitry by connections reverse to one another such that connections between the first switch and the first control circuitry and second control circuitry are mirrored by connections between the second switch and the first control circuitry and second control circuitry.

16. The method of claim 15, wherein upon controlling the first and second interrupt relays to stop allowing the power from the battery to be supplied to the starter, further power will not be supplied to the starter until the ignition switch is turned to "off," then to "on," and then to "start."

17. The method of claim 15, further comprising controlling the first and second interrupt relays to allow the power from the battery to be supplied to the starter in response to the ignition switch being turned to "start."

* * * * *